US005963764A

United States Patent [19]

de la Rosette et al.

[11] Patent Number: 5,963,764

[45] Date of Patent: Oct. 5, 1999

[54] METHOD AND IMAGE-FORMING APPARATUS FOR FORMING AT LEAST TWO TONER IMAGES IN REGISTER ON A CHARGE RETENTIVE MEDIUM

[75] Inventors: Johannes P. M. de la Rosette, Venlo, Netherlands; Theodoor Herman Geerken, Halle-Zoersel, Belgium; Cornelis P. M. van Heijst, Venlo, Netherlands

[73] Assignee: Oce-Technologies B.V., Venlo, Netherlands

[21] Appl. No.: 09/081,772

[22] Filed: May 21, 1998

[30] Foreign Application Priority Data

May 21, 1997 [NL] Netherlands ..... 1006098

[51] Int. Cl.[6] ..... G03G 15/01

[52] U.S. Cl. ..... 399/231; 430/106.6; 430/122

[58] Field of Search ..... 399/231, 232, 399/223, 267, 270; 430/42, 44, 45, 106.6, 122; 347/115

[56] References Cited

U.S. PATENT DOCUMENTS

| | | | |
|---|---|---|---|
| 4,255,040 | 3/1981 | Weigl et al. | 399/5 |
| 4,734,735 | 3/1988 | Haneda | 399/231 |
| 4,810,610 | 3/1989 | Grushkin et al. | 430/106.6 |
| 4,847,655 | 7/1989 | Parker et al. | 399/232 |
| 4,935,324 | 6/1990 | Grushkin et al. | 430/106.6 X |
| 5,061,969 | 10/1991 | Parker et al. | 399/232 |
| 5,180,650 | 1/1993 | Sacripante et al. | 430/106.6 |
| 5,181,072 | 1/1993 | Furuya et al. | 399/223 X |
| 5,367,327 | 11/1994 | Harris | 347/115 |
| 5,438,401 | 8/1995 | Murayama et al. | 399/228 |

FOREIGN PATENT DOCUMENTS

| | | |
|---|---|---|
| 59-031970 | 2/1984 | Japan . |
| 60-008852 | 1/1985 | Japan . |

*Primary Examiner*—Arthur T. Grimley
*Assistant Examiner*—Sophia S. Chen

[57] ABSTRACT

A method of, and image-forming device for, forming at least two toner images in register on a rotatable charge retentive medium. To that end, within one revolution of the charge retentive medium, the method: applies a first charge image according to a first image; develops a first toner image in accordance with the first charge image on the charge retentive medium by applying a first unary electrically conductive and magnetizable toner, e.g., via a first magnetic brush; applies a second charge image according to a second image; and develops a second toner image in accordance with the second charge image on the charge retentive medium by applying a second unary electrically conductive and magnetizable toner, e.g., via a second magnetic brush. The toner should have an electrical conductivity between 1 and $10^{-7}$ $(\text{ohm.cm})^{-1}$. If the charge retentive medium is a photoconductor, then the method includes: charging the photoconductive medium; and exposing the photoconductive medium in accordance with the first and the at least second image, respectively.

14 Claims, 7 Drawing Sheets

CONVENTIONAL ART

CONVENTIONAL ART

METHOD AND IMAGE-FORMING APPARATUS FOR FORMING AT LEAST TWO TONER IMAGES IN REGISTER ON A CHARGE RETENTIVE MEDIUM

FIELD OF THE INVENTION

The invention relates to a method and image-forming apparatus for forming at least two toner images in register on a rotatable charge retentive medium.

BACKGROUND OF THE INVENTION

A method and image-forming apparatus for forming two or more toner images on a rotating charge retentive medium can be used, for example, to apply to a print not only a black toner but a toner having an accentuating colour. In the case of more than two developing means it can also be used to apply more colors in order to produce a full-colour print. Since instead of being collected on an extra collecting medium or on the print material, the various toner images are now collected in register on a charge retentive medium itself, so that a compact and relatively inexpensive apparatus is obtained. Furthermore, better register is possible since there is no transfer of the separate toner images to a collecting intermediate medium of this kind.

The problem in collecting a plurality of toner images on a charge retentive medium, however, is that the toner applied by the first developing means must pass the second developing means. The first toner layer applied may be disturbed by the second developing means. To obviate this as far as possible, special additional steps are necessary. One of the steps is usually contactless "scavengeless" development of toner by disposing a wire having an AC voltage applied thereto, for example next to a developing roller. This causes a toner cloud. The disadvantage of this is that it is complicated to perform in the case of wide formats.

U.S. Pat. No. 4,847,655 (the '655 patent), for example, describes a tri-level xerographic developing system for developing a plurality of toner images on a charge retentive medium constructed as a photoconductor. The photoconductor in this case is first charged uniformly, preferably negatively, by a corona, whereafter three separate charge levels are obtained on the photoconductor by tri-level laser exposure. The non-discharged areas, corresponding to a maximum negative charge, are intended for development of positively charged black toner (Charged Area Development) while the maximum discharged areas are intended for development of negatively charged colour toner (Discharged Area Development). The half-discharged areas are not intended for toner development.

Black and colour toner respectively are developed in a first developing station and a second developing station situated downstream, respectively, by a pair of magnetic rollers. In this case the toner is charged triboelectrically by suitable carrier particles, i.e., the toner is a binary toner having two components, namely toner particles and carrier particles. It is stated in the '655 patent that development with an insulating magnetic brush has really not been found suitable for tri-level development since charge fields occur at the edges of a first developed image so that toner intended for a second image is developed here. On the other hand, it is stated in the '655 patent that thin lines are however developed less satisfactorily with a (more) conductive magnetic brush. In the embodiment described, therefore, by the use of adapted toner concentrations, charge levels of the toner and developing distances, development is carried out as well as possible with relatively more conductive magnetic brushes. The electrical conductivity of the toner as measured in a Gutman conductivity cell is in the range from $1\times10^{-9}$ to $1\times10^{-13}$ $(\text{ohm.cm})^{-1}$.

In order to limit the disturbance of the first developed image by the second developed image, the two magnetic rollers in the second developing station have magnetic fields which are specially designed to differ from one another.

The special construction of the second developing station, however, increases costs, while the use of toner which is relatively somewhat less insulating necessitates extra and hence limiting development settings.

U.S. Pat. No. 5,061,969 (the '969 patent) describes another embodiment of a tri-level xerographic developing system with a charge retentive medium again in the form of a photoconductor. In this case, instead of two developing stations both having an insulating magnetic brush or, as in the embodiment in the above-described U.S. Pat. No. 4,847,655 (two relatively less insulating magnetic brushes), a combination of an insulating magnetic brush and a relatively less insulating magnetic brush is used. In this case, the term less insulating denotes a conductivity of less than $1\times10^{-13}$ $(\text{ohm.cm})^{-1}$ and insulating denotes a conductivity between $1\times10^{-13}$ and $1\times10^{-15}$ $(\text{ohm.cm})^{-1}$. The developer (toner and carrier) is again of the binary type. In this case colour is first developed with the less insulating magnetic brush and then black with the insulating brush. In the developed colour image, there will be less large electrical edge fields than is the case when developing with an insulating magnetic brush. This reduces the risk of unwanted development of black at colour edges. On the other hand, thin lines and sharp edges can be obtained in the case of black, by development thereof with an insulating magnetic brush. The '969 patent also describes an optional charge device in the form of a scorotron corona situated between the two developing stations. This serves to bring the developed colour image to the same potential as the background level for white. Unwanted electrical edge fields are also reduced further here.

The disturbance of the first developed colour image by the second developing station is admittedly reduced, but it is still present, as is evident from the described extra step of the charge device between the two developing stations.

U.S. Pat. No. 5,367,327 (the '327 patent) describes, for example, a tandem device of a tri-level xerographic developing system with a quad-level xerographic developing system. With the quad-level developing system, four charge levels are produced on a photoconductor, so that blue, yellow and black toner can be developed. With the tri-level system, magenta and cyan toner are then developed. Since the developing station for tri-level development (which is arranged as the second developing station) uses an exposure in the red or infrared wavelength range, the photoconductor may also be exposed at those places where yellow toner is present that has already been developed by the quad-level developing station (which is arranged as the first station). The yellow toner is the only one of the toners that is transparent to this wavelength. By depositing magenta toner on the insulating yellow toner with the tri-level developing station, red is obtained, and by depositing cyan toner on the yellow toner green is obtained. In this way a full-colour print can be obtained.

For full-colour, therefore, as regards wavelength, a different exposure must be chosen for a developing station compared with laser exposure.

SUMMARY OF THE INVENTION

The method according to the invention partially or completely obviates the above disadvantages and is characterised by the application of a unary electrically conductive and magnetizable toner to the charge retentive medium during the first and the at least second-time development.

The above-mentioned prior art toners are of the binary or two-component type. Carrier particles are present in the prior art toners to ensure tribo-electric charging of the insulating toner particles. The invention is based in part on the realisation that these "hard" iron-containing conductive carrier particles are responsible for mechanical disturbance of a toner layer previously applied to a photoconductor.

The invention is also based in part on the realisation that it is precisely by the use of insulating toner used in such binary systems that there is a risk of unwanted development of new toner taking place on a previously applied first layer. The charge induced in the first layer by a second layer leaks away less rapidly in the case of insulating toner than in the case of conductive toner. The most that is present in the case of conductive toner is a charge at the contact surface of the toner on the photoconductor but not, or to a much reduced degree, at the side of the toner facing a developing station. Toner from a following developing station will accordingly adhere either not at all or less rapidly to toner that has already been applied, since the charge induced by the new toner in the side of the already-present layer of toner facing the developing station leaks away rapidly.

Thus a unary or one-component (e.g., toner particles without carrier particles) electrically conductive toner not only gives a "softer" toner brush, but also a development of, in principle, a one-layer (or uni-layer) toner.

Any edge field in the case of edges of a developed first layer of toner will also disappear more quickly with unary electrically conductive toner.

It should be noted here that although the above-mentioned U.S. Patents refer to conductive toner, this must be interpreted rather as a less insulating toner. The '655 refers to a toner as conductive if it has a cell conductivity between $10^{-9}$ and $10^{-13}$(ohm.cm)$^{-1}$. However, such a range of cell conductivity is not sufficient to be able to operate with unary toner since unary toner must be capable of being sufficiently inductively charged by way of an applied developing voltage. Unary electrically conductive toner according to the invention preferably has an electrical conductive toner having an electrical conductivity of between 1 and $1\times10^{-7}$ (ohm.cm)$^{-1}$, and more preferably, an electrical conductivity of between $1\times10^{-3}$ and $1\times10^{-4}$ (ohm.cm)$^{-1}$.

Application of the charge images can be effected in various ways. For example, it can be effected ionographically by a charge writing device, e.g., in the form of an array of writing electrodes on a charge retentive medium constructed as a dielectric. In the case of a charge retentive medium constructed as a photoconductor, the method according to the invention comprises, for the first charge image, successively charging the photoconductive medium a first time to a first charging level and exposing the photoconductive medium a first time in accordance with a first image in order to obtain the first charge image thereon and, for the second charge image, successively exposing the photoconductive medium in accordance with the second image in order to obtain the second charge image thereon.

A first embodiment of the method and associated apparatus according to the invention: exposes, during the first exposure, only those areas of the photoconductive medium where no toner is to be applied in accordance with the first image and wherein the first charging level is reduced locally to, e.g., approximately a zero level; applies toner, during the first development of the first toner image, to the non-exposed parts of the photoconductive medium by maintaining a developing voltage corresponding approximately to the zero level between first developing device and the photoconductive medium; thereafter charges the photoconductive medium a second time to approximately the first charging level; exposes during the second exposure, only those areas of the photoconductive medium where no toner is to be applied in accordance with the second image and wherein the first charging level is reduced locally to approximately a zero level; and applies toner, during the second development of the second toner image, to the non-exposed parts of the photoconductive medium by maintaining a developing voltage corresponding approximately to the zero level between second developing device and the photoconductive medium.

By charging a second time it is possible to develop two toner images in register in one revolution of a photoconductor on non-exposed charged parts of a photoconductor. Using the terminology of the '655 patent, this would be known as Charged Area Development. This method of development will in this description be referred to as "white writing" in order to indicate that exposure is effected at places where there is no development. The advantage of white writing is that it can be founded on current analogue (as compared with digital) processes, which often write white. Another advantage of white writing is that a relatively uneven charge is often adequate.

A second embodiment of the method and associated apparatus according to the invention: exposes during the first exposure, only those areas of the photoconductive medium where no toner is to be applied in accordance with the first image and wherein the first charging level is reduced locally to a second level situated between the first charging level and approximately a zero level; applies toner, during the first development of the first toner image, to the non-exposed parts of the photoconductive medium by maintaining a developing voltage corresponding approximately to the second level between first developing device and the photoconductive medium; exposes during the second exposure, only those areas of the photoconductive medium where no toner is to be applied in accordance with the second image and wherein the second level is reduced locally to approximately a zero level; and applies toner, during the second-time development of the second toner image, to the non-exposed parts of the photoconductive medium by maintaining a developing voltage corresponding approximately to the zero level between second developing device and the photoconductive medium.

Although this second embodiment again makes use of white writing twice, no re-charging of the photoconductor is necessary. The reason for this is that since the charging level of the photoconductor is exposed to two instead of one exposure level, a second charging device, such as are present in the first embodiment, are unnecessary. Also, the possible detachment of toner as a result of a second charging is avoided.

The third (and most preferred) embodiment of the method according to the invention: exposes during the first exposure, only those areas of the photoconductive medium where toner is to be applied in accordance with the first image and wherein the first charging level is reduced locally to, e.g., approximately a zero level; applies toner, during the first development of the first toner image, to the exposed parts of the photoconductive medium by maintaining a developing voltage corresponding approximately to the first charging level between the first developing device and the photoconductive medium; exposes during the second exposure, those areas of the photoconductive medium where toner is to be applied in accordance with the second image and wherein the second charging level is reduced locally to, e.g., approximately a zero level; and applies toner, during the second development of the second toner image, to the exposed parts of the photoconductive medium by maintaining a developing voltage corresponding approximately to the first charging level between the second developing device and the photoconductive medium.

In this case, using the terminology of the '655 patent, development is in accordance with Discharged Area Development. Hereinafter this will be referred to as "black writing", since the exposure is made where toner is subsequently also developed. Although "black writing" poses high requirements in respect of the uniformity of the charge and hence is not without problems, "black writing" appears in practice to result in the least disturbance to a first toner image in combination with the development of the said unary conductive toner.

A fourth embodiment according to the invention: exposes during the first exposure, only those areas of the photoconductive medium where toner is to be applied in accordance with the first image and wherein the first charging level is reduced locally to, e.g., approximately a zero level; applies toner, during the first-time development of the first toner image, to the exposed parts of the photoconductive medium by maintaining a developing voltage corresponding approximately to the first charging level between the first developing device and the photoconductive medium; exposes during the second exposure, only those areas of the photoconductive medium where no toner is to be applied in accordance with the second image and wherein the first charging level is reduced locally to approximately the zero level; applies toner, during the second development of the second toner image, to the non-exposed parts of the photoconductive medium by maintaining a developing voltage corresponding approximately to the zero level between the second developing device and the photoconductive medium.

In this case, the first toner image is obtained preferably by "black writing" and the second toner image by "white writing". This is advantageous in existing apparatus, most of which in practice is of the white writing type, and which is to be made suitable for a second colour or more colors. By applying colored toner as the first toner image and black toner as the second toner image there is less risk of the generally weaker magnetic colour toner being absorbed by the second developing device.

In general, methods in which development is via "black writing" are particularly preferable, despite the higher requirements in respect of the uniformity of the charge, in the above-mentioned application with unary conductive toner.

The foregoing and other objectives of the present invention will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

DETAILED DESCRIPTION OF THE PREFERRED EMBODIMENTS

Figure 1:
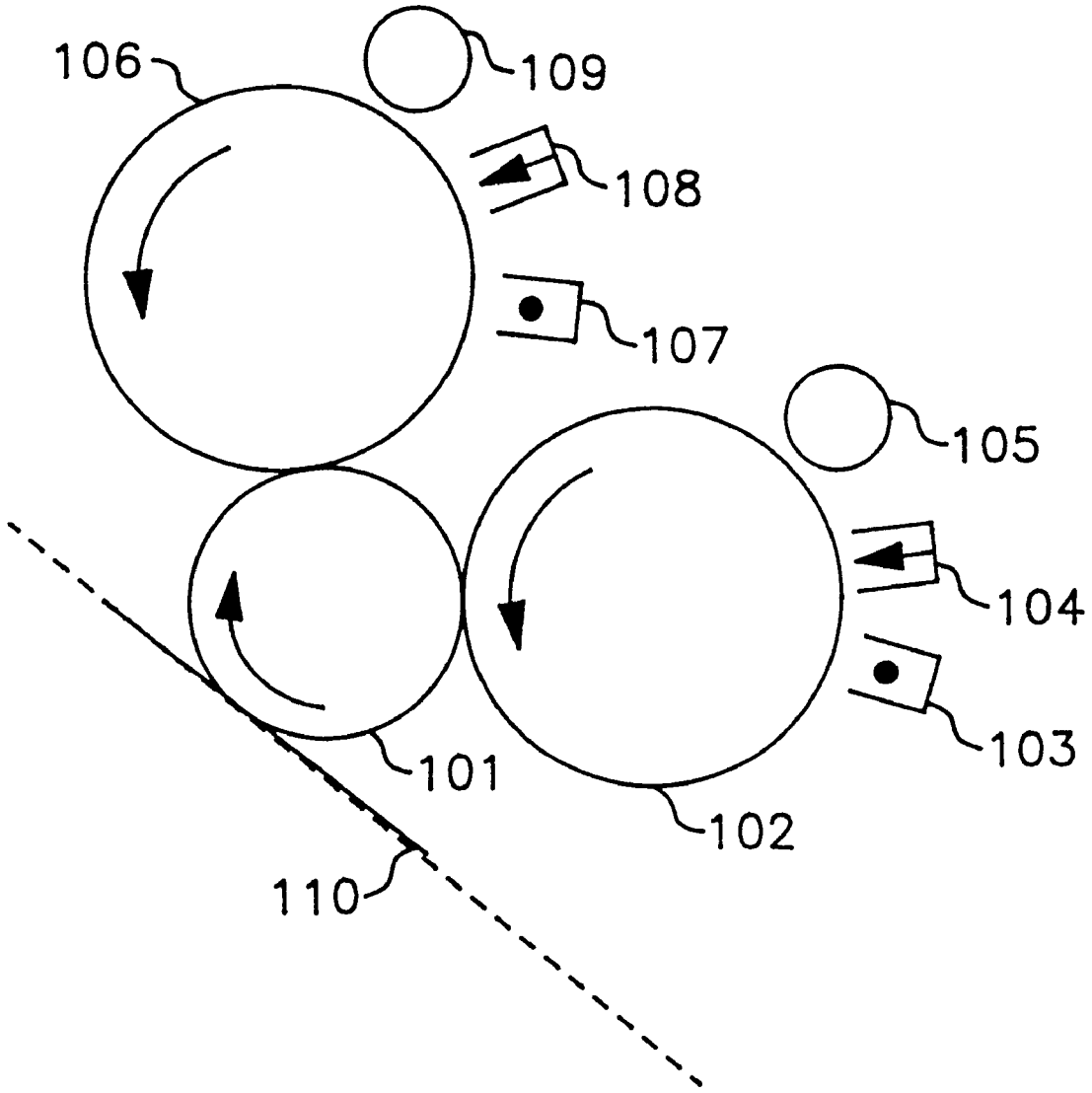
FIG. 1 is a diagram of a conventional image-forming apparatus in which toner images are collected in register on an intermediate medium.

FIG. 1 diagrammatically illustrates a conventional image-forming apparatus for collecting toner images in register on an intermediate medium 101. In this case the latter is constructed as a cylindrical body of revolution. A first photoconductor 102, also constructed as a cylindrical body of revolution, is charged, by first charging device 103, for example a corona wire, to a first charging level. A suitable first exposure device 104, for example a laser or an LED bar, disposed further on in the direction of rotation, exposes the photoconductor 102 in accordance with a first image. Either the areas where toner is to be developed or the areas where no toner is to be developed are exposed and thus discharged. In the former case we refer to black writing and in the latter case white writing.

It should be noted here that in the case of a charge retentive medium constructed as a dielectric, the charge image can be applied thereto pixel-wise directly ionographically, for example by an array of electrodes.

The toner for development is then applied to the exposed or non-exposed areas by first developing device 105 situated further on in the direction of rotation. In the case of black writing, in which the areas for development are discharged, the developing device 105 will apply charged toner to these areas, which are of the same polarity as the photoconductor. In the case of white writing, on the other hand, the developing device 105 of opposite polarity will apply toner to the areas for developing.

The developing device 105 can in this case be adapted to develop binary or two-component toner consisting of a mixture or developer of conductive carrier particles and insulating toner particles. Charging of the toner particles takes place by friction tribo-electrically. The developing device 105 can also be adapted to develop unary or one-component toner of the conductive type. Charging then takes place by creating a charging current via the toner itself. The first toner image thus developed on the photoconductor 102 is then transferred by electric force or pressure to the intermediate medium 101. The toner may also be magnetizable so that it can be applied by suitable magnetic rollers.

A second photoconductor 106, second charging device 107, second exposure device 108 and second developing device 109 then develop a second toner image on the photoconductor 106. This is then also transferred to the intermediate medium 101 by electric force or by pressure, in register with the previously transferred first toner image already present thereon.

The final two toner images collected on the intermediate medium 101 are then jointly transferred in a known way to a final image support, such as a paper sheet 110.

It should be clear that the conventional art apparatus of FIG. 1 is complex and bulky because of the intermediate medium 101 and also because of the second photoconductor.

Figure 2:
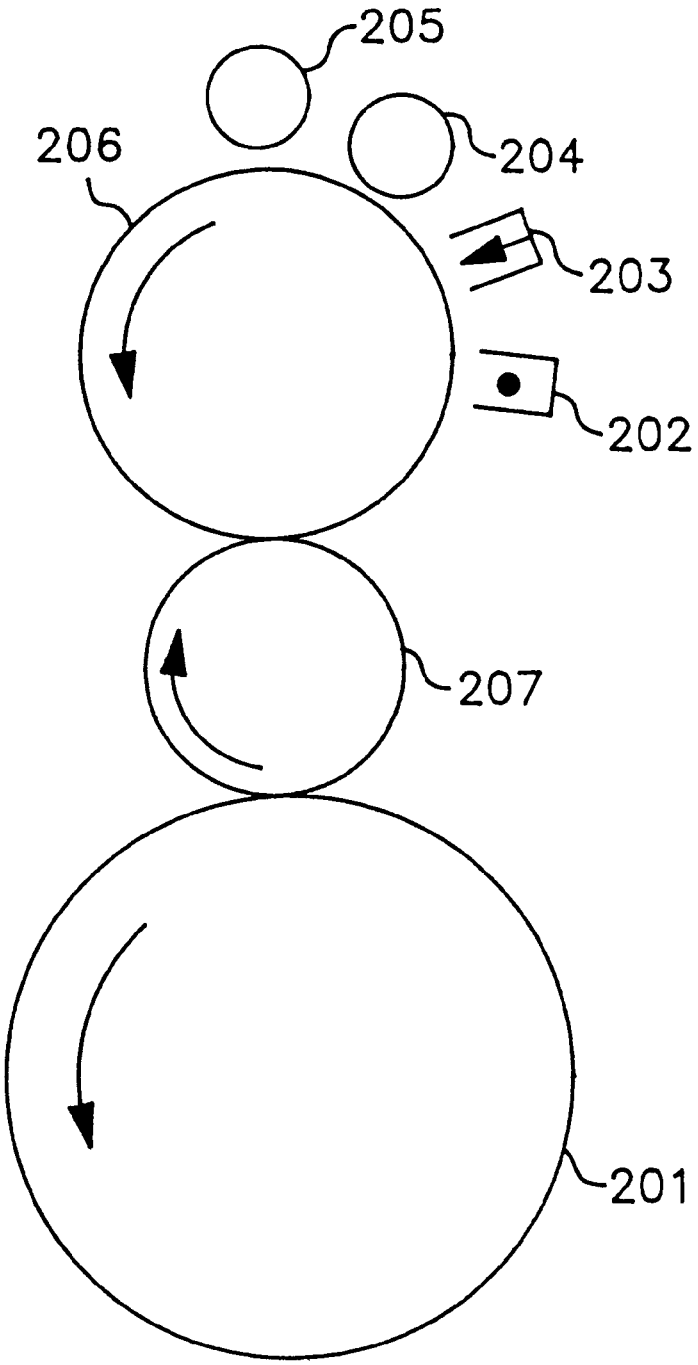
FIG. 2 diagrammatically illustrates a conventional image-forming apparatus in which toner images are collected in register on a copy sheet.

FIG. 2 shows an image-forming apparatus according to the conventional art in which the toner images are simultaneously collected in register on the final copy support. To this end, a copy support (not shown in detail) is trained over a cylindrical copy support body 201. The image-forming apparatus also comprises charging device 202, exposure device 203, first and second developing devices 204 and 205, and a cylindrical photoconductor 206.

In this case a first toner image is developed by the developing device 204 in a first revolution of the photoconductor 206. In these conditions the second developing device 205 is in an inoperative state, so that no disturbance of the first developed toner image can take place. The first developed toner image is then transferred via a cylindrical intermediate medium 207 to the copy support trained over the copy support body 201. The second toner image is then developed on the photoconductor 206 during a second revolution thereof, by the second developing device 205, and is then transferred to the copy support in register with the first toner image by the intermediate medium 207. The first developing device 204 is now in an inoperative state during this.

With respect to the conventional art apparatus shown in FIG. 2 there is in this case only one photoconductor, but as a result two revolutions are required to collect two toner images in register and there is therefore also a loss of productivity. The collecting of toner images on the copy support also has the disadvantage of poorer registration because of the less rigidly defined properties of a copy support and the necessary transfer steps.

Developing devices 204 and 205 of conventional FIG. 2 disadvantageously must also be switchable to an operative or inoperative mode.

Figure 3:
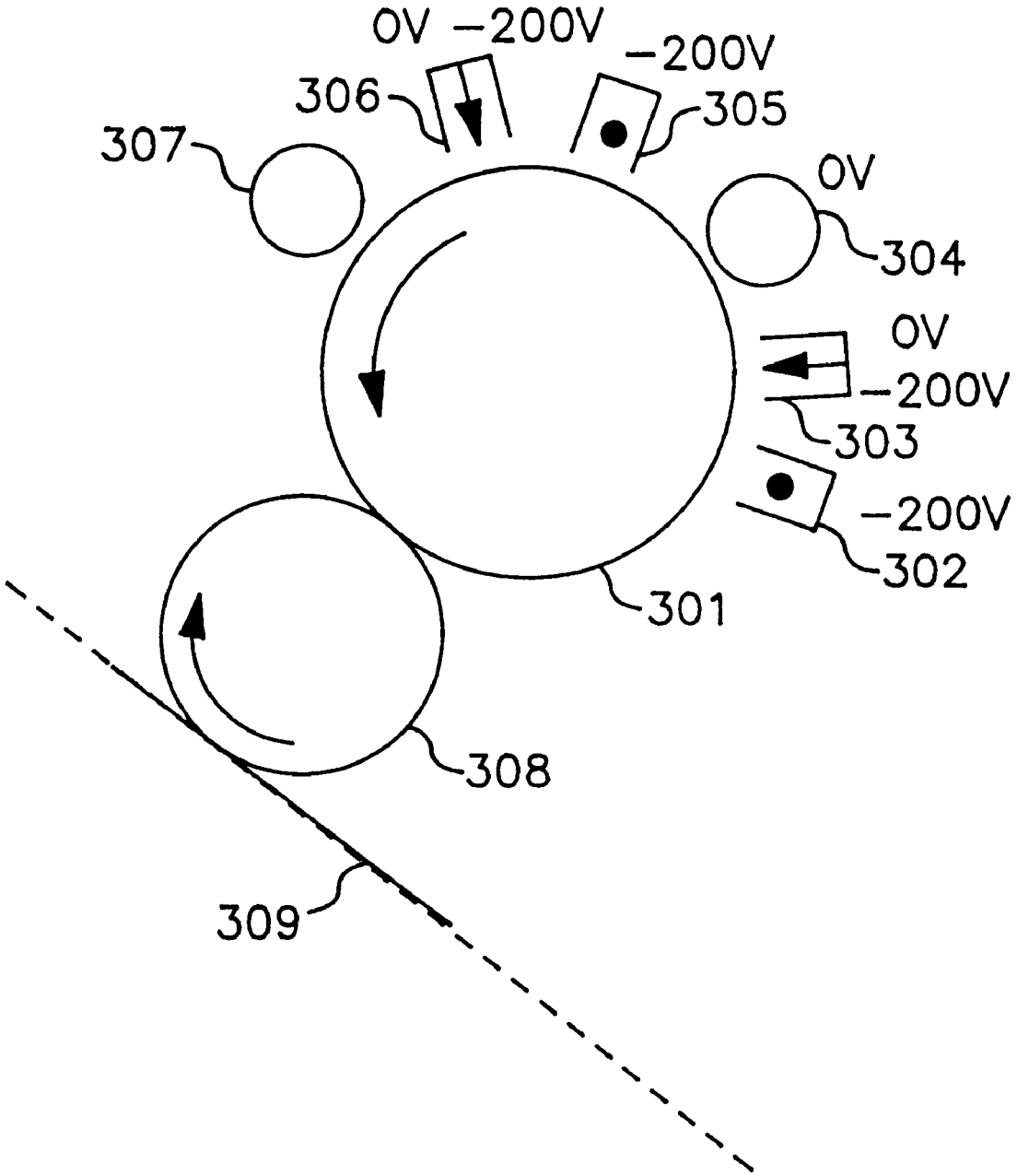
FIG. 3 diagrammatically illustrates an image-forming apparatus according to a first embodiment of the invention.

FIG. 3 diagrammatically illustrates an image-forming apparatus in accordance with a first embodiment of the invention. Here, a photoconductor 301 constructed as a cylindrical body of revolution is provided, and can be charged to a charging level of, e.g., −200 V over the entire width uniformly by suitable charging device 302, such as a scorotron. First exposure device 303, such as an LED printhead of 300 dpi, then illuminates those areas where no toner has to be developed (white writing). Those parts of the photoconductor 301 which are exposed by the exposure device 303 are charged to, e.g., a zero level, at which no more toner can be developed. In this embodiment, the photoconductor 301 is practically completely discharged on those areas. The zero level then corresponds to approximately 0 volt. First developing device 304 situated further on in the direction of rotation, such as, for example, a cylinder having in the direction of the length a number of magnets surrounded by a sleeve rotating around the cylinder, is suitable for applying a unary or a one-component conductive magnetic toner to the non-exposed areas of the photoconductor 301 by maintaining a first developing voltage U1 equal to the zero level with respect to the photoconductor, and hence in this case 0 volt. In this context, the term conductive toner denotes toner having a cell conductivity greater than $1\times10^{-7}$ (ohm.cm)$^{-1}$. A preferred range of values is: toner having a cell conductivity between $1\times10^{-4}$ and $1\times10^{-3}$ (ohm.cm)$^{-1}$, a particle size distribution between 7 and 35 mm, and a magnetic volume percentage between 0.25 and 2.5%.

The toner conductivity was measured as follows: a cylindrical container having an inside diameter of 17.2 mm, a copper base 1.5 mm thick and a wall having an internal height of 22.9 mm, consisting of polytetrafluoroethlyene, sold under the trademark TEFLON, in a thickness of 9 mm, was filled with an excess of toner. The filling was then tamped ten times with a tamper manufactured by Engelsman A. G. of Ludwigshafen, Germany. This filling procedure was carried out twice. The excess toner was then stripped off with a ruler. A copper lid having a diameter of 17.2 mm and a mass of 55 g was then placed on the column of toner. The filled container was then placed in a Faraday cage and a 10 volt DC was applied between the base and the lid. The current density was measured for 20 seconds. The measuring procedure (filling the container and the current measurement) was repeated three times, whereupon the average current density was calculated. The toner resistance is given by the following formula:

$$\rho=(U/lg)*(A/h)$$

where U=the applied voltage (10 volts)

A=the contact area of the lid with the column of toner ($2.32\ 10^{-4}m^2$)

h=the height of the column of toner ($2.29\ 10^{-2}$m)

lg=the average current intensity (A)

Preferably, the attempt will be made to keep the magnetic volume percentage of toners for colors and certainly for light colors as low as possible in order to keep the colour saturation as high as possible. As a compensation, stronger magnetic fields must be used in the developing device for toners having a low magnetic volume percentage. In practice, the magnetic poles used in the magnetic brush have a radial magnetic field strength in the developing nip on the sleeve surface for colour toner of about 2900 Gauss and for black and dark colour toner a magnetic field strength of about 650 Gauss. It is in this context advantageous first to develop colour toner and only then black toner since the weak magnetic colour toner will not be rapidly taken up by a weak magnetic developing roller for black toner.

In order to place a second toner image in register over the developed first toner image during the same revolution of the photoconductor 301, charging, exposure and developing for the second toner image must take place before a revolution is completed. To this end, there are disposed successively in the direction of rotation after the first developing device 304: second charging device 305, second exposure device 306 and second developing device 307. The device 305 comprises for this purpose a scorotron in order again to charge the photoconductor uniformly to, e.g., −200 volts. The exposure device 306 comprises, e.g., an LED printhead of 300 dpi for exposure of those areas where no toner of the second toner image is to be developed. In this case the exposure is such that the second toner image in principle always comes to lie next to and not over the first toner image. The exposed areas of the photoconductor are in this case again discharged to approximately a zero level, in this case approximately 0 volt. By maintaining a second developing voltage U2 of 0 volt between the second developing device 307 and the photoconductor 301, toner is developed only on the non-exposed areas of the photoconductor 301.

Since use is made of conductive toner, there is no charge build-up in that part of the first developed toner layer which faces the developing device 307. In this first layer there is only a mirror image charge in that part of the toner which contacts the photoconductor. The finally collected toner image therefore consists in principle of just one layer of toner. The toner of the second developing device which comes into contact with the already developed first layer of toner will—since the charge induced as a result in the first layer rapidly leaks away—also quickly no longer experience any electric force therefrom.

As already stated, preferably, black toner is developed in the second developing device 307. The final one-layer multi-colour toner image is then transferred in one operation, by pressure and heat, in a first transfer step to an intermediate roller 308. The toner image collected on the intermediate roller 308 is finally transferred by a second transfer step to a final copy support 309.

One advantage of the embodiment described in FIG. 3 is that the entire charge range of the photoconductor 301 is utilized.

As already stated, the method and apparatus according to the invention can also be used in the case of direct ionographic pixel-wise application of the charge images to a charge retentive medium in the form of a dielectric, by way of an array of electrodes.

Figure 4:
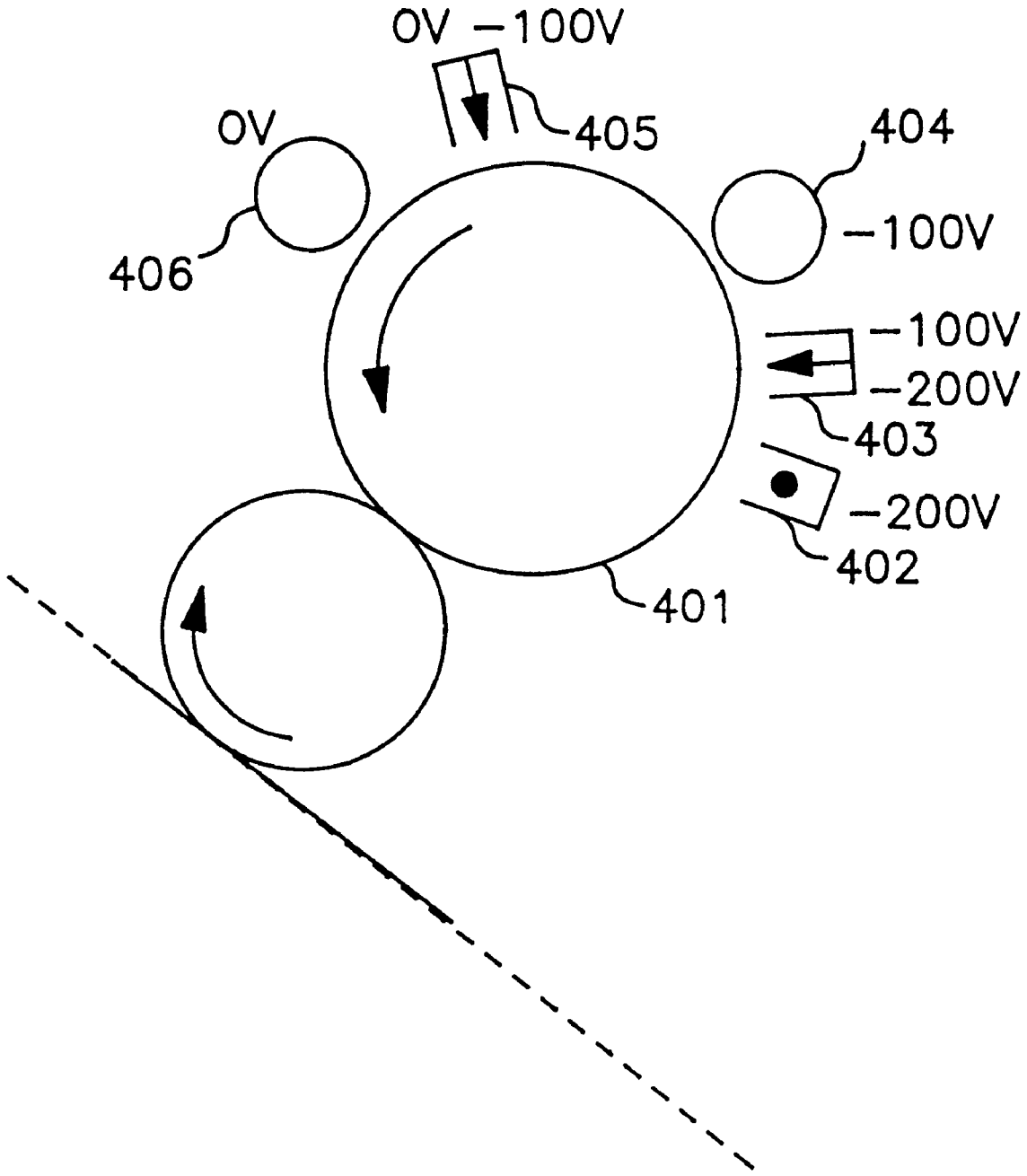
FIG. 4 diagrammatically illustrates an image-forming apparatus according to a second embodiment of the invention.

In FIG. 4, however, a second embodiment of the invention is described wherein the photoconductor 401 provided is exposed to two exposure levels. In this case, the photoconductor 401 is again charged up to the maximum charging level of, e.g., −200 volts first of all by charging device 402. First exposure device 403, on the other hand, now discharges those areas of the photoconductor 401 when no toner is to be developed by the first developing device 404, to half the maximum charging level of, e.g., −200 volts and the zero level of 0 volt, in this case approximately −100 volts. By now maintaining the first developing voltage U1 between the first developing device 404 and the photoconductor at 100 volts, only toner of the first toner image is developed on the non-exposed and charged areas. This therefore is again a case of white writing.

The second exposure device 405 then exposes the photoconductor 401 at those places where no toner is to be developed by the second developing device 406. In this case the exposed parts of the photoconductor 401 are discharged to the zero level, in this case 0 volt. By maintaining the second developing voltage U2 between these second developing device 406 and the photoconductor 401 at the zero level, toner is only developed at those areas where there is still a charge level of −100 volts (white writing). As already stated previously, no second layer is developed on the first layer which has already been developed.

One advantage of the second embodiment described here is the absence of second charging device. Also, in the second embodiment, there is less risk of the first toner layer detaching in the event of renewed interim complete charging as is the case in the first embodiment.

Figure 5:
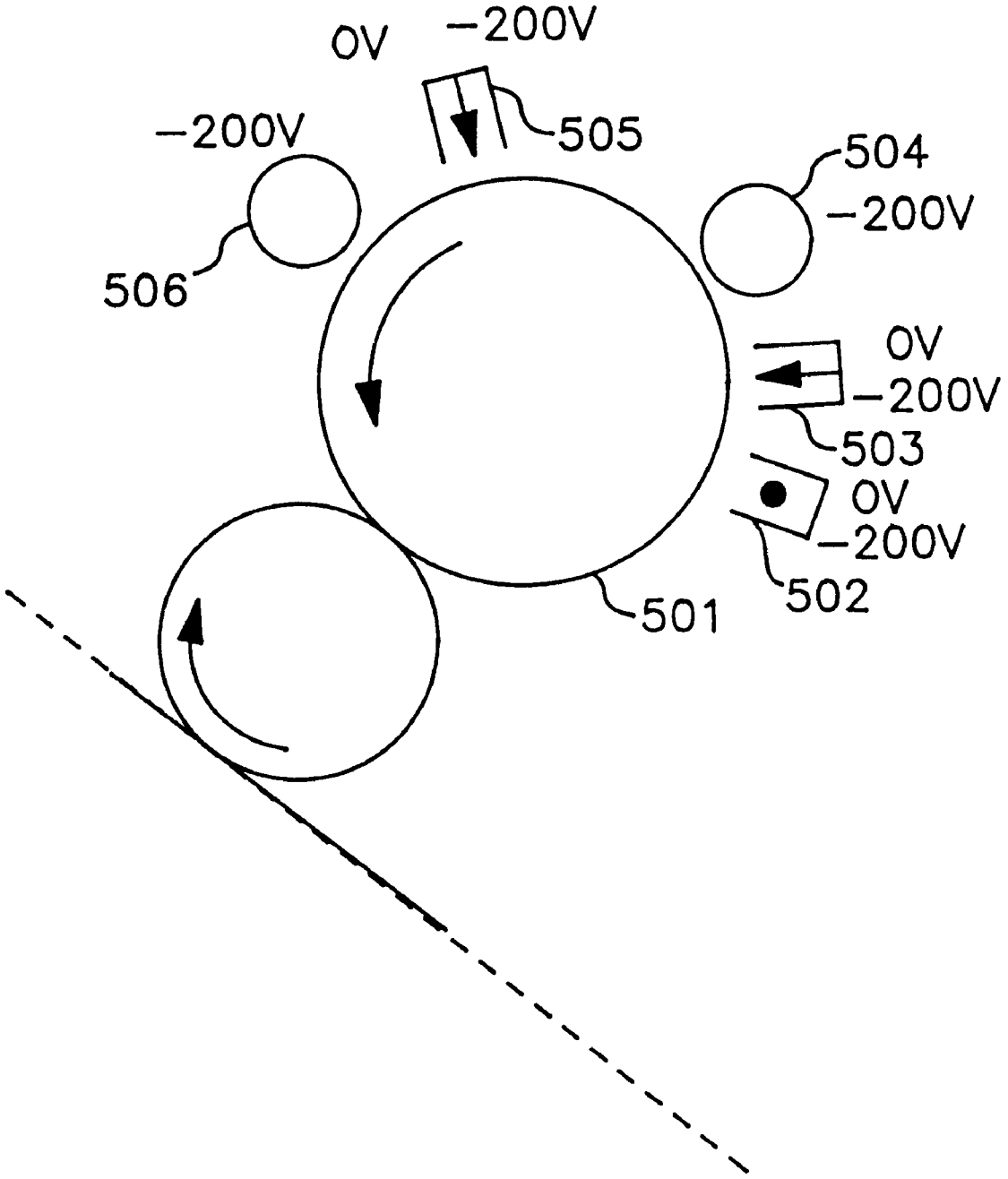
FIG. 5 diagrammatically illustrates an image-forming apparatus according to a third embodiment of the invention.

FIG. 5 shows a third embodiment according to the invention in which charging is again carried out just once but without using a division of the charging level of the photoconductor 502. Charging device 501 again charges the photoconductor 501 uniformly to the maximum charging level, e.g., in this case −200 volts. The first exposure device 503, on the other hand, now exposes those areas of the photoconductor 501 where toner is to be developed by the first developing device 504. The exposed areas are in this case discharged to a zero level of, e.g., in this case, approximately 0 volts. By now maintaining the first developing voltage U1 between the first developing device 503 and the photoconductor 501 at, e.g., approximately −200 volts, toner is developed only on the exposed and discharged areas of the photoconductor 501 (black writing).

Those areas of the photoconductor 501 where toner is to be developed by the second developing device 506 are then exposed by second exposure device 505. By maintaining a second developing voltage U2 of −200 volts between the second developing device 506 and the photoconductor 501, the second toner is developed only on the discharged areas of the photoconductor 501 (black writing). One advantage of black writing is that an intermediate charging or division of the charging level as described in the previous embodiments is unnecessary.

On the other hand, black writing poses higher requirements in respect of the uniformity of the charge in order to counteract any background development.

Figure 6:
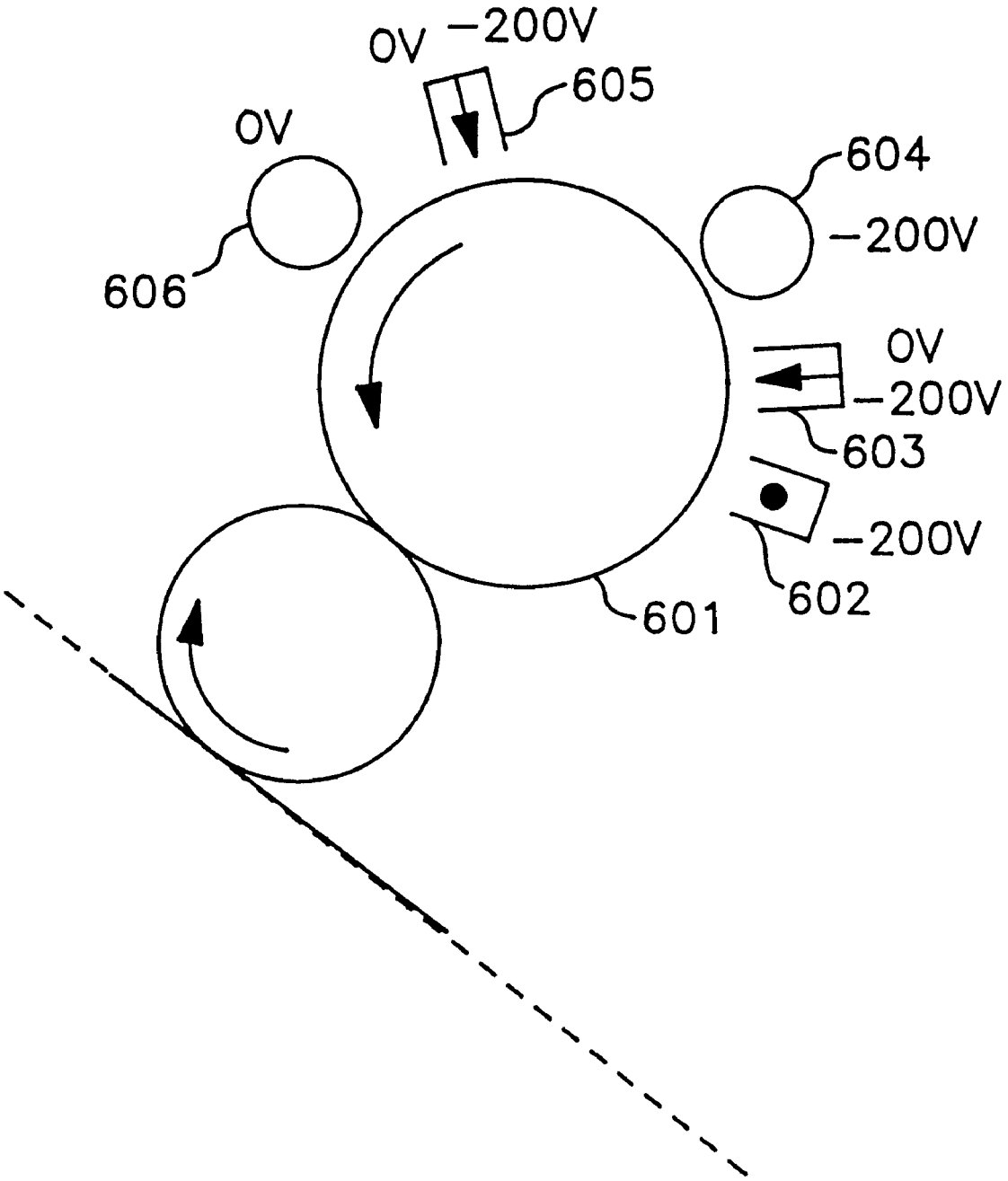
FIG. 6 diagrammatically illustrates an image-forming apparatus according to a fourth embodiment of the invention.

FIG. 6 therefore shows a fourth embodiment of the invention in which black and white writing are combined in one embodiment. This embodiment is particularly suitable for expanding existing one-colour white-writing toner systems with one or more extra toners of different colour. In this case the first or colour toner is developed via black writing in first developing device 604 situated in the direction of rotation of a photoconductor 601. The first toner is preferably developed with relatively the weakest magnetisation in this case, as is the toner for colour in most cases, using the first developing device 604. The photoconductor 601 is uniformly charged by charging device 602 to a maximum charging level of, e.g., −200 volts in this case. Exposure device 603 then exposes those areas of the photoconductor 601 on which colour toner is to be developed by the first developing device 604. In this case these areas are again discharged to a zero level of, e.g., in this case, approximately 0 volt. By keeping the first developing voltage U1 between the first developing device 604 and the photoconductor 601 at the level of approximately 200 volts, toner is developed only on the exposed and discharged areas (black writing). Those parts of the photoconductor where no toner may be developed by the second developing device are then exposed with second exposure device 605. In this case the exposure discharges the photoconductor again to the zero level of 0 volt. By maintaining the developing voltage U2 between the second developing device 606 and the photoconductor at, e.g., approximately 0 volt, the second or black toner is developed only on those areas of the photoconductor 601 which have not been exposed by the exposure device 605.

In this case good multi-colour registration is obtained without causing unwanted black toner development in colored areas or without affecting colored areas.

It should finally be noted that although the invention has been illustrated with reference to embodiments in which two different toners are used, the invention is not limited thereto. Even if the risk of disturbance increases when more than two developing devices are used, multi-colour systems and even full-colour systems are possible with a development of a photoconductor in one revolution with unary, conductive and magnetic toner.

Figure 7:
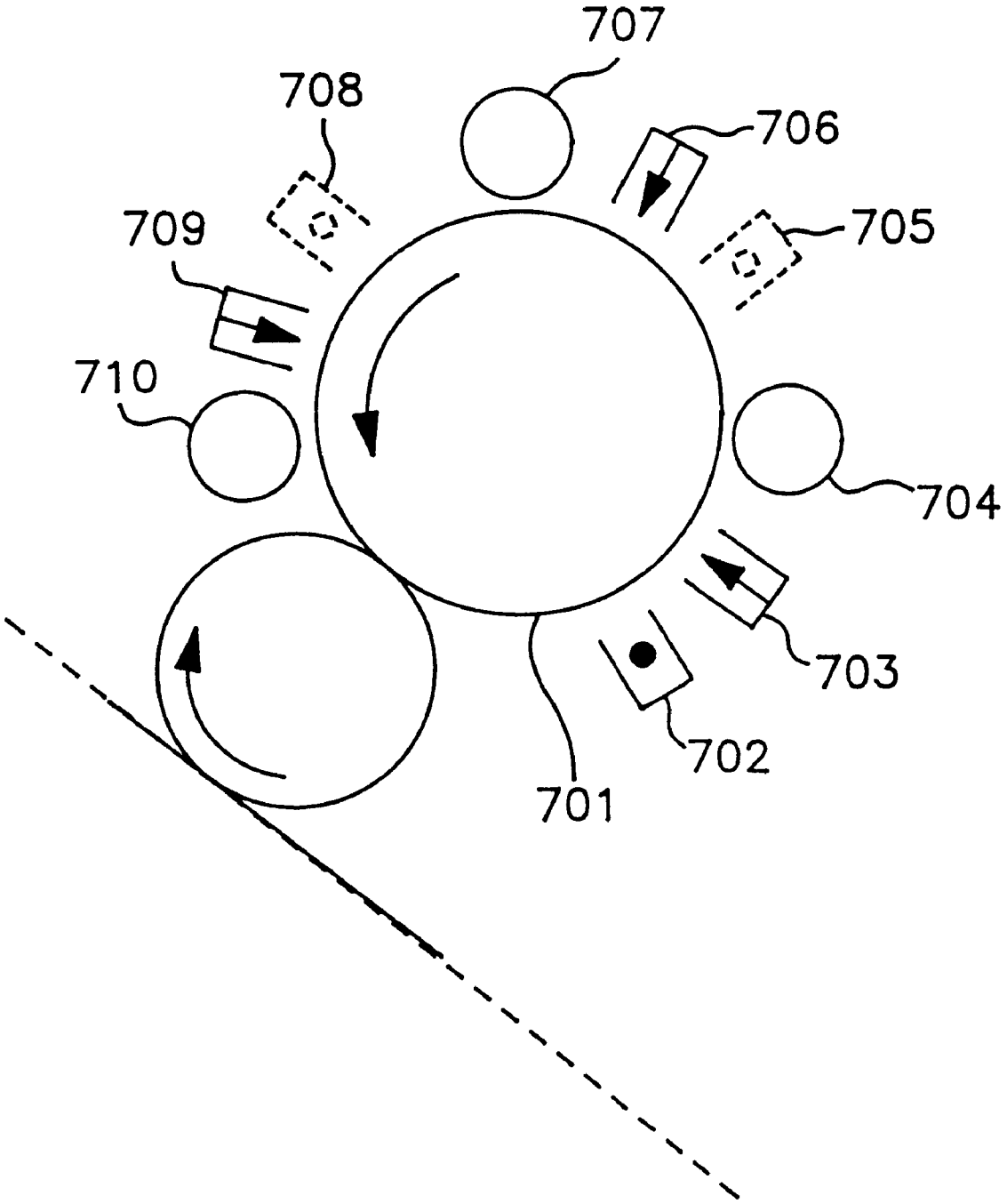
FIG. 7 diagrammatically illustrates an image-forming apparatus, according to an alternative embodiment of the invention, that has more than two image-forming subsystems.

FIG. 7 depicts an alternative embodiment of the invention having more than two image-forming subsystems. In FIG. 7, three image-forming subsystems are formed about the circumference of the photoconductor 701. The first image-forming subsystem includes a charging device 702, a first exposure device 703 and a first developing device 704. The second image-forming subsystem includes an optional charging device 705, a second exposure device 706 and a second developing device 707. The third image-forming subsystem includes an optional charging device 708, a third exposure device 709 and a third developing device 710. The image-forming subsystems of FIG. 7 can use either white writing technology or black writing technology.

Also, the polarities and levels of the developing voltages and charging levels referred to in the examples are just an example. Other values (e.g., that implement black writing for white writing, and vice-versa) can be selected for these depending on the properties of the photoconductors and toners. Of course this is possible without appreciably affecting the character of white or black writing.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A method of forming at least two toner images in register on a rotatable charge retentive medium, the method comprising successively in one revolution of the charge retentive medium the steps of:

a) applying, to the charge retentive medium during said revolution, a first charge image in accordance with a first image;

b) applying a first unary electrically conductive and magnetizable toner, by means of a first magnetic brush, to the charge retentive medium, during said revolution, to develop a first toner image in accordance with the first charge image;

c) applying, to the charge retentive medium during said revolution, a second charge image in accordance with a second image; and d) applying a second unary electrically conductive and magnetizable second toner, by means of a second magnetic brush, to the charge retentive medium, during said revolution, to develop a second toner image in accordance with the second charge image.

2. The method according to claim 1, wherein an electrical conductivity of said first and second unary electrically conductive and magnetizable toners is between 1 and $1\times10^{-7}$ (ohm.cm)$^{-1}$.

3. The method according to claim 2, wherein said electrical conductivity of said first and second unary electrically conductive and magnetizable toners is between $1\times10^{-3}$ and $1\times10^{-4}$ (ohm.cm)$^{-1}$.

4. The method according to claim 1, wherein:

the charge retentive medium is a photoconductive medium;

said step a) includes e) charging the photoconductive medium a first time to a first charging level, and f) exposing the photoconductive medium in accordance with said first image in order to obtain the first charge image thereon; and said step c) includes g) exposing the photoconductive medium in accordance with the second image in order to obtain the second charge image thereon.

5. The method according to claim 4, wherein:

said step f) exposes only those areas of the photoconductive medium where no toner is to be applied in accordance with the first image such that the first charging level is reduced locally to approximately a zero level;

said step b) includes applying toner to non-exposed parts of the photoconductive medium by maintaining a developing voltage corresponding approximately to the zero level between said first magnetic brush and the photoconductive medium;

said method further comprises h) charging the photoconductive medium a second time to approximately the first charging level;

said step g) exposes only those areas of the photoconductive medium where no toner is to be applied in accordance with the second image such that the first charging level is reduced locally to approximately a zero level; and said step d) includes applying toner to non-exposed parts of the photoconductive medium by maintaining a developing voltage corresponding approximately to the zero level between said second magnetic brush and the photoconductive medium.

6. The method according to claim 4, wherein:

said step f) exposes only those areas of the photoconductive medium where no toner is to be applied in accordance with the first image such that the first charging level is reduced locally to a second level situated between the first charging level and approximately a zero level;

said step b) includes applying toner to non-exposed parts of the photoconductive medium by maintaining a developing voltage corresponding approximately to the second level between said first magnetic brush and the photoconductive medium;

said step g) exposes only those areas of the photoconductive medium where no toner is to be applied in accordance with the second image such that the second level is reduced locally to approximately a zero level; and said step d) includes applying toner to non-exposed parts of the photoconductive medium by maintaining a developing voltage corresponding approximately to the zero level between said second magnetic brush and the photoconductive medium.

7. The method according to claim 4, wherein:

said step f) exposes only those areas of the photoconductive medium where toner is to be applied in accordance with the first image such that the first charging level is reduced locally to approximately a zero level;

said step b) includes applying toner to the exposed parts of the photoconductive medium by maintaining a developing voltage corresponding approximately to the first charging level between the first magnetic brush and the photoconductive medium;

said step g) exposes those areas of the photoconductive medium where toner is to be applied in accordance with the second image such that a second charging level is reduced locally to approximately a zero level; and said step d) includes applying toner to exposed parts of the photoconductive medium by maintaining a developing voltage corresponding approximately to the first charging level between the second magnetic brush and the photoconductive medium.

8. The method according to claim 4, wherein:

said step f) exposes only those areas of the photoconductive medium where toner is to be applied in accordance with the first image such that the first charging level is reduced locally to approximately a zero level;

said step b) includes applying toner to exposed parts of the photoconductive medium by maintaining a developing voltage corresponding approximately to the first charging level between the first magnetic brush and the photoconductive medium;

said step g) exposes only those areas of the photoconductive medium where no toner is to be applied in accordance with the second image such that the first charging level is reduced locally to approximately the zero level;

said step d) includes applying toner to non-exposed parts of the photoconductive medium by maintaining a developing voltage corresponding approximately to the zero level between the second magnetic brush and the photoconductive medium.

9. The method according to claim 1, further comprising:

applying, to the charge retentive medium during said revolution, a third charge image in accordance with a third image; and applying a third unary electrically conductive and magnetizable toner to develop a third toner image in accordance with the third charge image.

10. An apparatus for forming at least two toner images in register successively in one revolution of a rotatable charge retentive medium, the apparatus comprising:

said rotatable charge retentive medium;

first charging means for applying, to the charge retentive medium during said revolution, a first charge image in accordance with a first image;

first development means for applying a first unary electrically conductive and magnetizable toner to said charge retentive medium, during said revolution, to develop a first toner image in accordance with the first charge image, said first development means including a first magnetic brush;

second charging means for applying, to the charge retentive medium, during said revolution, a second charge image in accordance with a second image; and second development means for applying a second unary electrically conductive and magnetizable toner to the charger retentive medium, during said revolution, to develop a second toner image in accordance with the second charge image, said second development means including a second magnetic brush.

11. The apparatus according to claim 10, wherein an electrical conductivity of said first and second unary electrically conductive and magnetizable toners is between 1 and $1\times10^{-7}$ (ohm.cm)$^{-1}$.

12. The apparatus according to claim 11, wherein said electrical conductivity of said first and second unary electrically conductive and magnetizable toners is between $1\times10^{-3}$ and $1\times10^{-4}$ (ohm.cm)$^{-1}$.

13. The apparatus according to claim 10, wherein:

said first charging means includes first exposure means for exposing the charged charge-retentive medium to produce the first charge image thereon; and said second charging means includes second exposure means for exposing the charged charge-retentive medium to produce the first charge image thereon.

14. The apparatus according to claim 10, further comprising:

third charging means for applying, to the charge retentive medium during said revolution, a third charge image in accordance with a third image; and third development means for applying to the charge retentive medium, during said revolution, a third unary electrically conductive and magnetizable toner to develop a third toner image in accordance with the third charge image.

* * * * *